US006602941B2

(12) United States Patent
Higuchi et al.

(10) Patent No.: US 6,602,941 B2
(45) **Date of Patent: *Aug. 5, 2003**

(54) MULTI-PIECE SOLID GOLF BALL

(75) Inventors: Hiroshi Higuchi, Chichibu (JP); Atsushi Nanba, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/156,184

(22) Filed: May 29, 2002

(65) Prior Publication Data

US 2003/0013554 A1 Jan. 16, 2003

(30) Foreign Application Priority Data

May 30, 2001 (JP) ..... 2001-163263

(51) Int. Cl.[7] ..... A63B 37/06; C08K 3/22; C08L 9/00

(52) U.S. Cl. ..... 524/432; 524/526; 524/534; 473/357

(58) Field of Search ..... 473/357, 356, 473/359, 373, 374, 371, 372; 524/432, 908, 526, 534, 194

(56) References Cited

U.S. PATENT DOCUMENTS

| | | | | | |
|---|---|---|---|---|---|
| 4,683,257 | A | * | 7/1987 | Kakiuchi et al. | 473/372 |
| 4,929,678 | A | * | 5/1990 | Hamada et al. | 525/193 |
| 4,955,613 | A | * | 9/1990 | Gendreau et al. | 260/998.14 |
| 5,252,652 | A | * | 10/1993 | Egashira et al. | 473/372 |
| 5,733,205 | A | * | 3/1998 | Higuchi et al. | 473/373 |
| 6,194,505 | B1 | * | 2/2001 | Sone et al. | 473/371 |
| 6,315,679 | B1 | * | 11/2001 | Sano | 473/357 |

FOREIGN PATENT DOCUMENTS

| | | | |
|---|---|---|---|
| JP | 62-089750 | A | 4/1987 |
| JP | 63-275356 | | 11/1988 |
| JP | 02-228978 | A | 9/1990 |
| JP | 02-268778 | A | 11/1990 |
| JP | 03-151985 | A | 6/1991 |
| JP | 06-142228 | | 5/1994 |
| JP | 07-024084 | A | 1/1995 |
| JP | 07-268132 | A | 10/1995 |
| JP | 09-010358 | A | 1/1997 |
| JP | 11-035633 | A | 2/1999 |
| JP | 11-070187 | A | 3/1999 |
| JP | 11-164912 | A | 6/1999 |
| JP | 11-253578 | A | 9/1999 |
| JP | 11-253579 | A | 9/1999 |
| JP | 11-319148 | A | 11/1999 |
| JP | 11-319149 | A | 11/1999 |
| JP | 2000-70408 | A | 3/2000 |
| JP | 2000-70409 | A | 3/2000 |
| JP | 2000-70410 | A | 3/2000 |
| JP | 2000-70411 | A | 3/2000 |

OTHER PUBLICATIONS

M. R. Farrally, A. J. Cochran, "Science and Golf III", 1999, Human Kinetics, pp. 410, 412, 413.*

Report of Research & Development, Fine Chemical, vol. 23, No. 9, Jun. 1, 1994, pp. 5–15.

C. Jeff Harlan et al., "Three–Coordinate Aluminum Is Not A Prerequisite for Catalytic Activity in the Zirconocene—Alumoxane Polymerization of Ethylene", American Chemical Society, vol. 117, No. 24, 1995, pp. 6465–6474.

Mark R. Mason et al., "Hydrolysis of Tri–tert–butylaluminum: The First Structural Characterization of Alkylalumoxanes $[(R_2Al)_2O]_n$ $(RAlO)_n$", American Chemical Society, vol. 115, No. 12, 1993, pp. 4971–4984.

* cited by examiner

*Primary Examiner*—Paul T. Sewell
*Assistant Examiner*—Thanh Duong
(74) *Attorney, Agent, or Firm*—Sughrue Mion, PLLC

(57) ABSTRACT

In a multi-piece solid golf ball comprising a solid core, an inner cover layer and an outer cover layer, the solid core is molded from a rubber composition comprising a base rubber composed of (a) 20–100 wt % of a polybutadiene having a high cis-1,4 content, a minimal 1,2 vinyl content and a viscosity η of up to 600 mPa·s at 25° C. as a 5 wt % toluene solution, and satisfying a certain relationship between Mooney viscosity and polydispersity index in combination with (b) 0–80 wt % of another diene rubber, (c) an unsaturated carboxylic acid, (d) an organosulfur compound, (e) an inorganic filler, and (f) an organic peroxide; and the outer cover layer has a higher Shore D hardness than the inner cover layer. This combination of features gives the ball a good, soft feel upon impact and excellent flight performance.

9 Claims, No Drawings

MULTI-PIECE SOLID GOLF BALL

BACKGROUND OF THE INVENTION

1. Field of the Invention

The present invention relates to a multi-piece solid golf ball which has been imparted with a good, soft feel upon impact and an excellent flight performance.

2. Prior Art

Various improvements are being made in formulating the polybutadiene used as the base rubber in golf balls so as to confer the balls with outstanding rebound characteristics.

For example, JP-A 62-89750 describes rubber compositions for use as the base rubber in solid golf balls, which compositions are arrived at by blending a polybutadiene having a Mooney viscosity of 70 to 100 and synthesized using a nickel or cobalt catalyst with another polybutadiene having a Mooney viscosity of 30 to 90 and synthesized using a lanthanide catalyst or polybutadiene having a Mooney viscosity of 20 to 50 and synthesized using a nickel or cobalt catalyst.

However, further improvements in the materials are required in the above art to achieve golf balls endowed with an excellent flight performance.

JP-A 2-268778 describes golf balls molded using a blend composed of a polybutadiene having a Mooney viscosity of less than 50 and synthesized using a Group VIII catalyst in combination with a polybutadiene having a Mooney viscosity of less than 50 and synthesized with a lanthanide catalyst. However, golf balls with an excellent flight performance cannot be obtained in this way.

The existing art also teaches multi-piece solid golf balls in which an intermediate layer is molded of a low-Mooney viscosity polybutadiene (JP-A 11-70187), solid golf balls molded from rubber compositions comprising a polybutadiene having a Mooney viscosity of 50 to 69 and synthesized using a nickel or cobalt catalyst in combination with a polybutadiene having a Mooney viscosity of 20 to 90 and synthesized using a lanthanide catalyst (JP-A 11-319148), solid golf balls molded from compositions based on a rubber having a 1,2 vinyl content of at most 2.0% and a weight-average molecular weight to number-average molecular weight ratio Mw/Mn of not more than 3.5 (JP-A 11-164912), golf balls molded from rubber compositions containing a high Mooney viscosity polybutadiene (JP-A 63-275356), and golf balls molded from rubber compositions comprising polybutadiene having a high number-average molecular weight in admixture with polybutadiene having a low number-average molecular weight (JP-A 3-151985). However, none of these prior-art golf balls truly have a good, soft feel upon impact and an excellent flight performance that helps increase the distance traveled by the ball.

Golf balls having a cover composed of a relatively soft inner layer and a relatively hard outer layer have already been disclosed in JP-A 2-228978, JP-A 6-142228, JP-A 7-24084, JP-A 9-10358, JP-A 11-253578, JP-A 11-253579, JP-A 11-319149, JP-A 2000-70408, JP-A 2000-70409, JP-A 2000-70410, and JP-A 2000-70411. However, further improvements in distance are desired for the golf balls described in all of these specifications.

SUMMARY OF THE INVENTION

It is therefore an object of the present invention to provide multi-piece solid golf balls which are endowed with a good, soft feel when hit with a golf club and an excellent flight performance that helps increase the distance traveled by the ball when played.

The inventor has discovered that golf balls having a solid core, an inner cover layer over the cover, and an outer cover layer over the inner cover layer, wherein the solid core is made of a rubber composition formulated from a particular type of base rubber combined in specific proportions with certain other materials, and the outer cover layer is harder than the inner cover layer, exhibit a good synergy from optimization of the solid core materials and an appropriate distribution of hardness between the inner and outer cover layers. Multi-piece solid golf balls thus constituted have a good, soft feel when hit with a golf club and an excellent flight performance that enables the ball to travel further when played.

Accordingly, the invention provides a multi-piece solid golf ball having a solid core, an inner cover layer enclosing the core, and an outer cover layer enclosing the inner cover layer. The solid core is molded from a rubber composition comprising 100 parts by weight of a base rubber composed of (a) 20 to 100 wt % of a polybutadiene having a cis-1,4 content of at least 60% and a 1,2 vinyl content of at most 2%, having a viscosity $\eta$ at 25° C. as a 5 wt % solution in toluene of up to 600 mPa·s, and satisfying the relationship:

$$10B+5 \leqq A \leqq 10B+60,$$

wherein A is the Mooney viscosity ($ML_{1+4}$ (100° C.)) of the polybutadiene and B is the ratio Mw/Mn between the weight-average molecular weight Mw and the number-average molecular weight Mn of the polybutadiene, in combination with (b) 0 to 80 wt % of a diene rubber other than component (a). The rubber composition includes also (c) 10 to 60 parts by weight of an unsaturated carboxylic acid and/or a metal salt thereof, (d) 0.1 to 5 parts by weight of an organosulfur compound, (e) 5 to 80 parts by weight of an inorganic filler, and (f) 0.1 to 5 parts by weight of an organic peroxide. The outer cover layer has a higher Shore D hardness than the inner cover layer.

The polybutadiene (a) is typically synthesized using a rare-earth catalyst.

Preferably, the diene rubber (b) includes 30 to 100 wt % of a second polybutadiene which has a cis-1,4 content of at least 60% and a 1,2 vinyl content of at most 5%, has a Mooney viscosity ($ML_{1+4}$ (100° C.)) of not more than 55, and satisfies the relationship $$\eta \leqq 20A-550,$$

wherein A is the Mooney viscosity ($ML_{1+4}$ (100° C.)) of the second polybutadiene and $\eta$ is the viscosity, in mPa·s, of the second polybutadiene at 25° C. as a 5 wt % solution in toluene. The second polybutadiene in component (b) is typically synthesized using a Group VIII catalyst.

In the multi-piece solid golf ball of the invention, it is generally advantageous for the inner cover layer to have a Shore D hardness of 10 to 60 and the outer cover layer to have a Shore D hardness of 50 to 80.

DETAILED DESCRIPTION OF THE INVENTION

The golf ball of the invention includes a solid core made of a rubber composition in which the base rubber is at least partly polybutadiene. It is critical that the base rubber contain as component (a) a specific amount of a polybutadiene in which the cis-1,4 and 1,2 vinyl contents, the viscosity $\eta$ at 25° C. as a 5 wt % solution in toluene, and the relationship between the Mooney viscosity and the polydispersity index Mw/Mn have each been optimized.

That is, the polybutadiene (a) has a cis-1,4 content of at least 60%, preferably at least 80%, more preferably at least 90%, and most preferably at least 95%; and has a 1,2 vinyl content of at most 2%, preferably at most 1.7%, more preferably at most 1.5%, and most preferably at most 1.3%. Outside of the above ranges, the resilience declines.

The polybutadiene (a) must also have a viscosity η at 25° C. as a 5 wt % solution in toluene of not more than 600 mPa·s. "Viscosity η at 25° C. as a 5 wt % solution in toluene" refers herein to the value in mPa·s units obtained by dissolving 2.28 g of the polybutadiene to be measured in 50 ml of toluene and carrying out measurement with a specified viscometer at 25° C. using a standard solution for the viscometer (JIS Z8809).

The polybutadiene (a) has a viscosity η at 25° C. as a 5 wt % solution in toluene of not more than 600 mPa·s, preferably not more than 550 mPa·s, more preferably not more than 500 mPa·s, even more preferably not more than 450 mPa·s, and most preferably not more than 400 mPa·s. Too high a viscosity η lowers the workability of the rubber composition. It is recommended that the viscosity η be at least 50 mPa·s, preferably at least 100 mPa·s, more preferably at least 150 mPa·s, and most preferably at least 200 mPa·s. Too low a viscosity η may lower the resilience.

In addition, the polybutadiene (a) must satisfy the relationship:

$$10B+5 \leqq A \leqq 10B+60,$$

wherein A is the Mooney viscosity ($ML_{1+4}$ (100° C.)) of the polybutadiene and B is the ratio Mw/Mn between the weight-average molecular weight Mw and the number-average molecular weight Mn of the polybutadiene. A is preferably at least 10B+7, more preferably at least 10B+8 and most preferably at least 10B+9, but preferably not more than 10B+55, more preferably not more than 10B+50, and most preferably not more than 10B+45. If A is too low, the resilience declines. On the other hand, if A is too high, the workability of the rubber composition worsens.

It is recommended that the polybutadiene (a) have a Mooney viscosity ($ML_{1+4}$ (100° C.)) of at least 20, preferably at least 30, more preferably at least 40, and most preferably at least 50, but not more than 80, preferably not more than 70, more preferably not more than 65, and most preferably not more than 60.

The term "Mooney viscosity" used herein refers in each case to an industrial index of viscosity as measured with a Mooney viscometer, which is a type of rotary plastometer (see JIS K6300). This value is represented by the symbol $ML_{1+4}$ (100° C.), wherein "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

It is desirable for the polybutadiene (a) to be synthesized using a rare-earth catalyst. A known rare-earth catalyst may be used for this purpose.

Examples of suitable catalysts include lanthanide series rare-earth compounds, organoaluminum compounds, alumoxane, halogen-bearing compounds, optionally in combination with Lewis bases.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon residue of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

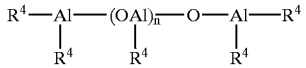

(I)

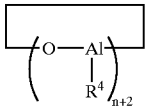

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon residue of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$ (wherein "Me" stands for methyl); and other metal halides such as silicon tetrachloride, tin tetrachloride and titanium tetrachloride.

The Lewis base may be used to form a complex with the lanthanide series rare-earth compound. Illustrative examples include acetylacetone and ketone alcohols.

In the practice of the invention, the use of a neodymium catalyst composed in part of a neodymium compound as the lanthanide series rare-earth compound is advantageous because it enables a polybutadiene rubber having a high cis-1,4 content and a low 1,2 vinyl content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30° C. to +150° C., and preferably 10° C. to 100° C.

It is also possible for the polybutadiene (a) to be obtained by polymerization using the above-described rare-earth catalyst, followed by the reaction of an end group modifier with active end groups on the polymer.

Any known end group modifier may be used. Examples include compounds of types (1) to (6) described below:

(1) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain a carbonyl or ester moiety as a side chain; M' is a tin atom, silicon atom, germanium atom or phosphorus atom; X is a halogen atom; and n is an integer from 0 to 3);

(2) heterocumulene compounds containing on the molecule a Y═C═Z linkage (wherein Y is a carbon atom, oxygen atom, nitrogen atom or sulfur atom; and Z is an oxygen atom, nitrogen atom or sulfur atom);

(3) three-membered heterocyclic compounds containing on the molecule the following bonds

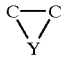

(wherein Y is an oxygen atom, a nitrogen atom or a sulfur atom);

(4) halogenated isocyano compounds;

(5) carboxylic acids, acid halides, ester compounds, carbonate compounds or acid anhydrides of the formulas $R^8$—$(COOH)_m$, $R^9(COX)_m$, $R^{10}$—(COO—$R^{11}$), $R^{12}$—OCOO—$R^{13}$, $R^{14}$—(COOCO—$R^{15}$)$_m$ or the following formula

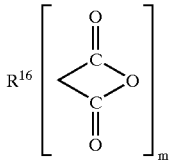

(wherein $R^8$ to $R^{16}$ are each independently a hydrocarbon group of 1 to 50 carbons; X is a halogen atom; and m is an integer from 1 to 5); and (6) carboxylic acid metal salts of the formula $R^{17}{}_lM''$ $(OCOR^{18})_{4-l}$, $R^{19}{}_lM''$ (OCO—$R^{20}$—$COOR^{21}$)$_{4-l}$ or the following formula

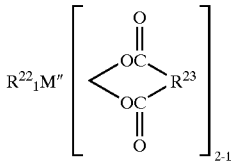

(wherein $R^{17}$ to $R^{23}$ are each independently a hydrocarbon group of 1 to 20 carbons, M" is a tin atom, a silicon atom or a germanium atom; and 1 is an integer from 0 to 3).

Illustrative examples of the end group modifiers of types (1) to (6) above and methods for their reaction are described in, for instance, JP-A 11-35633 and JP-A 7-268132.

In the practice of the invention, component (a) is included in the base rubber in an amount of at least 20 wt %, preferably at least 25 wt %, more preferably at least 30 wt %, and most preferably at least 35 wt %. The upper limit is 100 wt %, preferably not more than 90 wt %, more preferably not more than 80 wt %, and most preferably not more than 70 wt %.

In addition to component (a), the base rubber may include also a diene rubber (b) insofar as the objects of the invention are attainable. Specific examples of the diene rubbers (b) include polybutadiene rubber, styrene-butadiene rubber (SBR), natural rubber, polyisoprene rubber, and ethylene-propylene-diene rubber (EPDM). Any one or combination of two or more thereof may be used.

The diene rubber (b) is included together with component (a) in the base rubber in an amount of at least 0 wt %, preferably at least 10 wt %, more preferably at least 20 wt %, and most preferably at least 30 wt %, but not more than 80 wt %, preferably not more than 75 wt %, more preferably not more than 70 wt %, and most preferably not more than 65 wt %.

In the practice of the invention, it is preferable for component (b) to include a polybutadiene rubber, and especially one for which the cis-1,4 and 1,2 vinyl contents, the Mooney viscosity, and the relationship between the Mooney viscosity and η have each been optimized. The polybutadiene serving as component (b) is referred to as "second polybutadiene" in order to distinguish it from the polybutadiene serving as component (a).

It is recommended that the second polybutadiene in component (b) have a cis-1,4 content of at least 60%, preferably at least 80%, more preferably at least 90%, and most preferably at least 95%, and that it have a 1,2 vinyl content of at most 5%, preferably at most 4.5%, more preferably at most 4.0%, and most preferably at most 3.5%.

It is recommended that the second polybutadiene have a Mooney viscosity of at least 10, preferably at least 20, more preferably at least 25, and most preferably at least 30, but not more than 55, preferably not more than 50, and most preferably not more than 45.

In the practice of the invention, it is recommended that the second polybutadiene be one that has been synthesized using a Group VIII catalyst. Exemplary Group VIII catalysts include nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complexes. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include the following composed of cobalt or cobalt compounds: Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use the above in combination with a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkyl aluminum sesquichloride such as ethylaluminum sesquichloride; or aluminum chloride.

Polymerization using the Group VIII catalysts described above, and especially a nickel or cobalt catalyst, can generally be carried out by a process in which the catalyst is continuously charged into the reactor together with the solvent and butadiene monomer, and the reaction conditions are suitably selected from a temperature range of 5 to 60° C. and a pressure range of atmospheric pressure to 70 plus atmospheres, so as to yield a product having the above-indicated Mooney viscosity.

It is also desirable for the second polybutadiene in component (b) to satisfy the relationship:

$$20A-750 \leqq \eta \leqq 20A-550,$$

wherein η is the viscosity of the second polybutadiene at 25° C. as a 5 wt % solution in toluene and A is the Mooney viscosity ($ML_{1+4}$ (100° C.)) of the second polybutadiene. The viscosity η is preferably at least 20A−700, more preferably at least 20A−680, and most preferably at least 20A−650, but preferably not more than 20A−560, more preferably not more than 20A–580, and most preferably not more than 20A–590. The use of a polybutadiene having such an optimized relationship of η and A, that suggests the high linearity of polybutadiene molecules, is effective for conferring better resilience and workability.

The second polybutadiene generally accounts for at least 30 wt %, preferably at least 50 wt %, and most preferably at least 70 wt %, and up to 100 wt %, preferably up to 90 wt %, and most preferably up to 80 wt %, of the diene rubber (b). By including the second polybutadiene within component (b) in the foregoing range, even better extrudability and hence, workability during manufacture can be conferred.

The solid core in the golf balls of the invention is molded from a rubber composition containing as essential components specific amounts of (c) an unsaturated carboxylic acid and/or metal salt thereof, (d) an organosulfur compound, (e) an inorganic filler and (f) an organic peroxide per 100 parts by weight of the base rubber.

Specific examples of unsaturated carboxylic acids that may be used as component (c) include acrylic acid, methacrylic acid, maleic acid and fumaric acid. Acrylic acid and methacrylic acid are especially preferred.

Specific examples of unsaturated carboxylic acid metal salts that may be used as component (c) include the zinc and magnesium salts of unsaturated fatty acids such as zinc methacrylate and zinc acrylate. Zinc acrylate is especially preferred.

The unsaturated carboxylic acid and/or metal salt thereof used as component (c) is included in an amount, per 100 parts by weight of the base rubber, of at least 10 parts by weight, preferably at least 15 parts by weight, and most preferably at least 20 parts by weight, but not more than 60 parts by weight, preferably not more than 50 parts by weight, more preferably not more than 45 parts by weight, and most preferably not more than 40 parts by weight. Too much component (c) results in excessive hardness, giving the golf ball a feel upon impact that is difficult for the player to endure. On the other hand, too little component (c) undesirably lowers the resilience.

The organosulfur compound (d) of the rubber composition is essential for imparting good resilience. Exemplary organosulfur compounds include thiophenol, thionaphthol, halogenated thiophenols, and metal salts thereof. Specific examples include pentachlorothiophenol, pentafluorothiophenol, pentabromothiophenol, p-chlorothiophenol, and zinc salts thereof, such as the zinc salt of pentachlorothiophenol; and organosulfur compounds having 2 to 4 sulfurs, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred.

The organosulfur compound (d) is included in an amount, per 100 parts by weight of the base rubber, of at least 0.1 part by weight, preferably at least 0.2 part by weight, and most preferably at least 0.5 part by weight, but not more than 5 parts by weight, preferably not more than 4 parts by weight, more preferably not more than 3 parts by weight, and most preferably not more than 2 parts by weight. Too much organosulfur compound results in an excessively low hardness, whereas too little makes it impossible to enhance the resilience.

Examples of inorganic fillers that may be used as component (e) include zinc oxide, barium sulfate and calcium carbonate. The inorganic filler (e) is included in an amount, per 100 parts by weight of the base rubber, of at least 5 parts by weight, preferably at least 7 parts by weight, more preferably at least 10 parts by weight, and most preferably at least 13 parts by weight, but not more than 80 parts by weight, preferably not more than 50 parts by weight, more preferably not more than 45 parts by weight, and most preferably not more than 40 parts by weight. Too much or too little inorganic filler makes it impossible to achieve a golf ball core having an appropriate weight and good rebound characteristics.

The organic peroxide (f) may be a commercial product, suitable examples of which include Percumil D (manufactured by NOF Corporation), Perhexa 3M (manufactured by NOF Corporation) and Luperco 231XL (manufactured by Atochem Co.). If necessary, two or more different organic peroxides may be mixed and used together.

The organic peroxide (f) is included in an amount, per 100 parts by weight of the base rubber, of at least 0.1 part by weight, preferably at least 0.3 part by weight, more preferably at least 0.5 part by weight, and most preferably at least 0.7 part by weight, but not more than 5 parts by weight, preferably not more than 4 parts by weight, more preferably not more than 3 parts by weight, and most preferably not more than 2 parts by weight. Too much or too little organic peroxide makes it impossible to achieve a ball having a good feel upon impact and good durability and rebound characteristics.

If necessary, the rubber composition may also include an antioxidant, suitable examples of which include such commercial products as Nocrac NS-6, Nocrac NS-30 (both made by Ouchi Shinko Chemical Industry Co., Ltd.), and Yoshinox 425 (made by Yoshitomi Pharmaceutical Industries, Ltd.). The use of such an antioxidant in an amount, per 100 parts by weight of the base rubber, of at least 0 part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight, is desirable for achieving good rebound characteristics and durability.

The solid core of the invention can be produced by vulcanizing and curing the above-described rubber composition using a method like that employed with known rubber compositions for golf balls. For example, vulcanization may be carried out at a temperature of 100 to 200° C. for a period of 10 to 40 minutes.

In the practice of the invention, the solid core has a hardness which is suitably adjusted according to its manner of use in the various golf ball constructions that may be employed and is not subject to any particular limitation. The core may have a cross-sectional hardness profile which is flat from the center to the surface thereof, or which varies from the center to the surface.

It is recommended that the solid core have a deflection, when subjected to a load of 980 N (100 kg), of at least 2.0 mm, preferably at least 2.5 mm, more preferably at least 2.8 mm, and most preferably at least 3.2 mm, but not more than 6.0 mm, preferably not more than 5.5 mm, more preferably not more than 5.0 mm, and most preferably not more than 4.5 mm. Too small a deformation may worsen the feel of the ball upon impact and, particularly on long shots such as with a driver in which the ball incurs a large deformation, may subject the ball to an excessive rise in spin, reducing the carry. On the other hand, if the solid core is too soft, the golf ball tends to have a dead feel when hit, an inadequate rebound that results in a poor carry, and a poor durability to cracking with repeated impact.

It is recommended that the solid core in the inventive golf ball have a diameter of at least 30.0 mm, preferably at least 32.0 mm, more preferably at least 34.0 mm, and most preferably at least 35.0 mm, but not more than 40.0 mm, preferably not more than 39.5 mm, and most preferably not more than 39.0 mm.

It is also recommended that the solid core have a specific gravity of at least 0.9, preferably at least 1.0, and most preferably at least 1.1, but not more than 1.4, preferably not more than 1.3, and most preferably not more than 1.2.

The golf ball of the invention is a multi-piece solid golf ball having a cover composed of at least two layers which are referred to herein as the "inner cover layer" and the "outer cover layer." Such cover layers can be produced from known cover stock. The cover stocks used to make both cover layers in the inventive golf ball may be composed primarily of a thermoplastic or thermoset polyurethane elastomer, polyester elastomer, ionomer resin, ionomer resin having a relatively high degree of neutralization, polyolefin elastomer or mixture thereof. Any one or mixture of two or more thereof may be used, although the use of a thermoplastic polyurethane elastomer, ionomer resin, ionomer resin having a relatively high degree of neutralization or polyester elastomer is especially preferred.

Illustrative examples of thermoplastic polyurethane elastomers that may be used for the above purpose include commercial products in which the diisocyanate is an aliphatic or aromatic compound, such as Pandex T7298, Pandex T7295, Pandex T7890, Pandex TR3080, Pandex T8290, Pandex T8295 and Pandex T1188 (all manufactured by DIC Bayer Polymer, Ltd.). Illustrative examples of suitable commercial ionomer resins include Surlyn 6320, Surlyn 8945, Surlyn 9945 and Surlyn 8120 (both products of E.I. du Pont de Nemours and Co., Inc.), and Himilan 1706, Himilan 1605, Himilan 1855, Himilan 1557, Himilan 1601 and Himilan AM7316 (all products of DuPont-Mitsui Polychemicals Co., Ltd.). Commercial products of polyester elastomers are Hytrel 4047 and Hytrel 3078 (both of DuPont-Toray Co., Ltd.)

Together with the primary material described above, the cover stock may include also, as an optional material, polymers (e.g., thermoplastic elastomers) other than the foregoing. Specific examples of polymers that may be included as optional constituents include polyamide elastomers, styrene block elastomers, hydrogenated polybutadienes and ethylene-vinyl acetate (EVA) copolymers.

The multi-piece solid golf ball of the invention can be manufactured by any suitable known method without particular limitation. In one preferred method, the solid core is placed within a given injection mold, following which a predetermined method is used to successively inject over the core the above-described inner and outer cover layer materials. In another preferred method, each of the cover stocks is formed into a pair of half cups, and the resulting pairs are successively placed over the solid core and compression molded.

In the golf balls of the invention, it is critical that the outer cover layer have a higher Shore D hardness than the inner cover layer.

It is recommended that the inner cover layer have a Shore D hardness of at least 10, preferably at least 20, more preferably at least 25, and most preferably at least 30, but not more than 60, preferably not more than 55, more preferably not more than 50, and most preferably not more than 45.

It is recommended that the outer cover layer have a Shore D hardness of at least 50, preferably at least 53, more preferably at least 56, and most preferably at least 59, but not more than 80, preferably not more than 75, more preferably not more than 70, and most preferably not more than 65.

As noted above, in the practice of the invention the outer cover layer must have a higher Shore D hardness than the inner cover layer. It is advantageous for the outer and inner cover layers to have a difference in Shore D hardness of at least 2, preferably at least 5, more preferably at least 7, and most preferably at least 9 Shore D hardness units, but not more than 30, preferably not more than 25, and most preferably not more than 20 Shore D hardness units.

It is recommended that the inner and outer cover layers have a respective thickness of at least 0.7 mm, and preferably at least 1.0 mm, but not more than 3.0 mm, preferably not more than 2.5 mm, even more preferably not more than 2.0 mm, and most preferably not more than 1.6 mm.

The multi-piece solid golf ball of the invention can be manufactured for competitive use by imparting the ball with a diameter and weight which conform with the Rules of Golf; that is, a diameter of at least 42.67 mm and a weight of not more than 45.93 g. It is recommended that the diameter be no more than 44.0 mm, preferably no more than 43.5 mm, and most preferably no more than 43.0 mm; and that the weight be at least 44.5 g, preferably at least 45.0 g, more preferably at least 45.1 g, and most preferably at least 45.2 g.

Multi-piece solid golf balls according to the present invention have a good, soft feel upon impact and high rebound properties.

EXAMPLES

The following examples and comparative examples are provided to illustrate the invention, and are not intended to limit the scope thereof.

Examples 1–5 & Comparative Examples 1–4

The core materials shown in Table 2 were formulated in the indicated amounts per 100 parts by weight of polybutadiene material composed of polybutadiene types (1) to (7) below in the proportions shown in Table 1. The resulting core formulations were blended in a kneader or on a roll mill, then molded under applied pressure at 150° C. for 20 minutes to form solid cores having a diameter of about 35.3 mm.

Types of Polybutadiene (1) BRO1, made by JSR Corporation
(2) BR11, made by JSR Corporation
(3) UBE101, made by Ube Industries, Ltd.
(4) HCBN-4, an experimental grade of polybutadiene made by JSR Corporation
(5) HCBN-2, an experimental grade of polybutadiene made by JSR Corporation
(6) Experimental grade #9100081 made by Firestone
(7) Experimental grade #9100069 made by Firestone

TABLE 1

| Type | Catalyst | cis-1,4 content, % | 1,2 vinyl content, % | Mooney viscosity (A) | Mw/Mn (B) | η | 10B + 5 | 10B + 60 | 20A − 550 |
|---|---|---|---|---|---|---|---|---|---|
| Polybutadiene | | | | | | | | | |
| (1) | Ni | 96 | 2.5 | 44 | 4.2 | 150 | 47 | 102 | 330 |
| (2) | Ni | 96 | 2 | 44 | 4.4 | 270 | 49 | 104 | 330 |
| (3) | Co | 95 | 3 | 38 | 4.2 | 130 | 47 | 102 | 210 |
| (4) | Nd | 96 | 1.1 | 44 | 3.5 | 390 | 40 | 95 | 330 |
| (5) | Nd | 96 | 0.9 | 40 | 3.3 | 280 | 38 | 93 | 250 |
| (6) | Nd | 95 | 1.5 | 56 | 2.6 | 370 | 31 | 86 | 570 |
| (7) | Nd | 96 | 1.3 | 48 | 2.5 | 280 | 30 | 85 | 410 |

TABLE 2

| | Example | | | | | Comparative Example | | | |
|---|---|---|---|---|---|---|---|---|---|
| | 1 | 2 | 3 | 4 | 5 | 1 | 2 | 3 | 4 |
| Rubber formulation (pbw) | | | | | | | | | |
| (1) | | | | | | 50 | | | |
| (2) | 50 | 30 | 50 | 70 | | 50 | 50 | | 50 |
| (3) | | | | | 50 | | | 50 | |
| (4) | | | | 30 | | | | | |
| (5) | 50 | | | | 50 | | 50 | 50 | 50 |
| (6) | | 70 | | | | | | | |
| (7) | | | 50 | | | | | | |
| Core formulation (pbw) | | | | | | | | | |
| Polybutadiene | 100 | 100 | 100 | 100 | 100 | 100 | 100 | 100 | 100 |
| Dicumyl peroxide | 0.7 | 1.4 | 0.7 | 1.4 | 1.4 | 1.4 | 1.4 | 1.4 | 1.4 |
| 1,1-Bis(t-butylperoxy)-3,3,5-trimethylcyclo hexane | 0.3 | | 0.3 | | | | | | |
| Zinc oxide | 24.5 | 21 | 29 | 31 | 8.5 | 28.5 | 26.5 | 16 | 12 |
| Antioxidant | 0.2 | 0.2 | 0.2 | 0.2 | 0.2 | 0.2 | 0.2 | 0.2 | 0.2 |
| Zinc acrylate | 28 | 28 | 29 | 31 | 30 | 29 | 25 | 28 | 29 |
| Zinc salt of pentachlorothiophenol | 1 | 1 | 1 | 2 | 1 | 1 | 0 | 1 | 1 |

The resulting solid cores were tested as described below to determine their deformation under 980 N (100 kg) loading and their rebound. The results are shown in Table 4.

Deformation Under 980 N Loading

Measured as the deflection (mm) of the solid core when subjected to a load of 980 N (100 kg).

Rebound

The initial velocity of the solid cores was measured with the same type of initial velocity instrument as used by the official regulating body—the United States Golf Association (USGA). Each rebound value shown in Table 4 is the difference between the initial velocity of the solid core obtained in that particular example and the initial velocity of the solid core obtained in Comparative Example 2.

In each example, the resulting solid core was placed in a given mold and the appropriate resin shown in Table 3 was injection-molded over the core, thereby producing an inner layer-covered core having a diameter of about 38.7 mm. The covered core was then transferred to a given mold, and the appropriate resin shown in Table 3 was injection molded over the covered core, yielding a three-piece solid golf ball having a diameter of about 42.7 mm and a weight of about 45.3 g. Trade names appearing in Table 3 are described below.

Himilan: An ionomer resin produced by DuPont-Mitsui Polychemicals Co., Ltd.

Surlyn: An ionomer resin produced by E.I. du Pont de Nemours and Co.

Hytrel: A thermoplastic polyester elastomer produced by DuPont-Toray Co., Ltd.

Premalloy: A thermoplastic polyester elastomer base polymer alloy produced by Mitsubishi Chemical Co., Ltd.

Pandex: A polyurethane elastomer produced by Bayer-DIC Polymer, Ltd.

The properties of the resulting golf balls were determined as described below. The results are shown in Table 4.

Material Properties

The Shore D hardnesses of the inner cover layer and the outer cover layer were measured with a durometer by the test method described in ASTM D2240.

Golf Ball Properties

The carry and total distance were measured when the ball was hit at a head speed (HS) of 40 m/s with a driver (No. 1 Wood) mounted on a swing machine.

Feel

The feel of the ball when actually shot with a driver (No. 1 Wood) and putter was rated by five professional and five top-caliber amateur golfers as "Too hard," "Good" or "Too soft." The rating assigned most often to a particular ball was used as that ball's overall rating.

TABLE 3

| | A | B | C | D | E | F | G | H |
|---|---|---|---|---|---|---|---|---|
| Formulation (pbw) | | | | | | | | |
| Himilan 1706 | | | | | | 50 | | |
| Himilan 1605 | | | | | | 50 | | |
| Himilan 1601 | | | | | | | 50 | |
| Himilan 1557 | | | | | | | 50 | |
| Himilan AM7316 | | | | 100 | | | | |
| Surlyn 8120 | | | | | 100 | | | |
| Hytrel 4047 | 100 | | | | | | | |
| Hytrel 3078 | | | 60 | | | | | |
| Premalloy A1500 | | | 40 | | | | | |
| Pandex T1188 | | 100 | | | | | | |
| Pandex T8295 | | | | | | | | 100 |
| Behenic acid | | | | 20 | | | | |
| Magnesium oxide | | | | 3 | | | | |
| Titanium dioxide | | 2.7 | | 2 | 4 | 4 | 4 | 2.7 |

TABLE 4

| | Example | | | | | Comparative Example | | | |
|---|---|---|---|---|---|---|---|---|---|
| | 1 | 2 | 3 | 4 | 5 | 1 | 2 | 3 | 4 |
| Core properties | | | | | | | | | |
| Deflection (mm) under 980 N load | 4.0 | 3.9 | 3.7 | 4.0 | 3.5 | 3.8 | 4.0 | 4.0 | 3.9 |
| Secific gravity | 1.20 | 1.17 | 1.22 | 1.24 | 1.10 | 1.22 | 1.19 | 1.14 | 1.12 |
| Rebound (m/s) | +0.7 | +0.8 | +0.8 | +0.6 | +1.4 | +0.3 | 0 | +0.7 | +0.8 |
| Inner cover layer | | | | | | | | | |
| Type | A | B | C | D | A | C | A | E | C |
| Shore D hardness | 40 | 30 | 25 | 51 | 40 | 25 | 40 | 45 | 25 |
| Specific gravity | 1.12 | 1.19 | 1.04 | 0.97 | 1.12 | 1.04 | 1.12 | 0.98 | 1.04 |
| Thickness (mm) | 1.7 | 1.7 | 1.7 | 1.7 | 1.7 | 1.7 | 1.7 | 1.7 | 1.7 |
| Outer cover layer | | | | | | | | | |
| Type | F | G | G | F | H | G | F | B | B |
| Shore D hardness | 63 | 60 | 60 | 63 | 51 | 60 | 63 | 30 | 30 |
| Specific gravity | 0.98 | 0.98 | 0.98 | 0.98 | 1.18 | 0.98 | 0.98 | 1.19 | 1.19 |
| Thickness (mm) | 2.0 | 2.0 | 2.0 | 2.0 | 2.0 | 2.0 | 2.0 | 2.0 | 2.0 |
| Golf ball properties When hit with No. 1 Wood at HS 40 m/s | | | | | | | | | |
| Carry (m) | 181.8 | 180.7 | 180.7 | 182.5 | 180.1 | 177.6 | 177.5 | 175.2 | 173.0 |
| Total distance (m) | 203.5 | 202.0 | 201.8 | 205.1 | 200.8 | 198.8 | 199.0 | 196.1 | 193.6 |
| Feel on impact | good | good | good | good | good | good | good | too soft | too soft |
| Feel of ball when hit with putter | good | good | good | good | good | good | good | too soft | too soft |

Japanese Patent Application No. 2001-163263 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising a solid core, an inner cover layer and an outer cover layer, wherein the solid core is molded from a rubber composition comprising 100 parts by weight of a base rubber composed of (a) 20 to 100 wt % of a polybutadiene having a cis-1,4 content of at least 60% and a 1,2 vinyl content of at most 2%, having a viscosity η at 25° C. as a 5 wt % solution in toluene of up to 600 mPa·s, being synthesized using a rare-earth catalyst and satisfying the relationship:

$$10B+5 \leqq A \leqq 10B+60,$$

wherein A is the Mooney viscosity ($ML_{1+4}$(100° C.)) of the polybutadiene and B is the ratio Mw/Mn between the weight-average molecular weight Mw and the number-average molecular weight Mn of the polybutadiene, in combination with (b) 0 to 80 wt % of a diene rubber other than component (a), (c) 10 to 60 parts by weight of an unsaturated carboxylic acid or a metal salt thereof or both, (d) 0.1 to 5 parts by weight of an organosulfur compound, (e) 5 to 80 parts by weight of an inorganic filler, and (f) 0.1 to 5 parts by weight of an organic peroxide;

the inner cover layer has a Shore D hardness of 10 to 60;

the outer cover layer has a Shore D hardness of 50 to 80; and the outer cover layer has a higher Shore D hardness than the inner cover layer.

2. The golf ball of claim 1, wherein the diene rubber (b) includes 30 to 100 wt % of a second polybutadiene which has a cis-1,4 content of at least 60% and a 1,2 vinyl content of at most 5%, has a Mooney viscosity ($ML_{1+4}$ (100° C.)) of not more than 55, and satisfies the relationship:

$$\eta \leqq 20A-550,$$

wherein A is the Mooney viscosity ($ML_{1+4}$ (100° C.)) of the second polybutadiene and η is the viscosity of the second polybutadiene, in mPa·s, at 25° C. as a 5 wt % solution in toluene.

3. The golf ball of claim 1 wherein said polybutadiene (a) is synthesized by using neodymium catalyst.

4. The golf ball of claim 1 wherein said polybutadiene (a) has a Mooney viscosity ($ML_{1+4}$, 100° C.) of 40 to 60.

5. The golf ball of claim 1, wherein the outer cover layer and the inner cover layer have a difference in Shore D hardness of at least 5 units.

6. The golf ball of claim 1, wherein the outer cover layer and the inner cover layer have a difference in Shore D hardness of at least 7 units.

7. The golf ball of claim 1, wherein the outer cover layer and the inner cover layer have a difference in Shore D hardness of at least 9 units.

8. The golf ball of claim 1, wherein said ball is three-piece construction consisting of a solid core, an inner cover layer and an outer cover layer.

9. The golf ball of claim 2, wherein the second polybutadiene in component (b) is synthesized using a Group VIII catalyst.

* * * * *